US007965584B2

(12) United States Patent
Papi et al.

(10) Patent No.: US 7,965,584 B2
(45) Date of Patent: Jun. 21, 2011

(54) HOUR INDICATING RINGING MECHANISM

(75) Inventors: Alberto Papi, La Chaux-de-Fonds (CH); Pedro Nunes Marques, Le Locle (CH); Frederic Challet, Buttes (CH)

(73) Assignees: Vaucher Manufacture Fleurier S.A., Fleurier (CH); Sowind S.A., La Chaux-de-Fonds (CH)

( * ) Notice: Subject to any disclaimer, the term of this patent is extended or adjusted under 35 U.S.C. 154(b) by 143 days.

(21) Appl. No.: 12/523,120

(22) PCT Filed: Jan. 11, 2008

(86) PCT No.: PCT/EP2008/050302

§ 371 (c)(1),
(2), (4) Date: Jul. 14, 2009

(87) PCT Pub. No.: WO2008/090041

PCT Pub. Date: Jul. 31, 2008

(65) Prior Publication Data

US 2010/0046330 A1 Feb. 25, 2010

(30) Foreign Application Priority Data

Jan. 15, 2007 (EP) ..... 07100554

(51) Int. Cl.
*G04B 21/00* (2006.01)
*G10K 1/28* (2006.01)

(52) U.S. Cl. ..... 368/245; 116/149; 116/25; 368/243

(58) Field of Classification Search ..... 368/243, 368/245, 269–273; 116/25, 149–150, 154, 116/161

See application file for complete search history.

(56) References Cited

U.S. PATENT DOCUMENTS

| | | | | |
|---|---|---|---|---|
| 586,544 | A * | 7/1897 | Clements | 116/57 |
| 1,300,309 | A | 4/1919 | Wehinger | |
| 1,352,419 | A | 9/1920 | Herschede et al. | |
| 2,770,942 | A * | 11/1956 | Favret | 368/171 |
| 2,880,570 | A * | 4/1959 | Favret et al. | 368/171 |
| 3,230,921 | A * | 1/1966 | Spiegel | 116/67 R |
| 3,262,260 | A * | 7/1966 | Perrot-Audet | 368/170 |
| 3,338,048 | A * | 8/1967 | Stnder | 368/163 |
| 3,446,182 | A * | 5/1969 | Bschorr et al. | 116/147 |
| 7,590,030 | B2 * | 9/2009 | Moteki et al. | 368/75 |
| 7,733,744 | B2 * | 6/2010 | Subilia et al. | 368/272 |

(Continued)

FOREIGN PATENT DOCUMENTS

CH 661 996 8/1987

(Continued)

OTHER PUBLICATIONS

International Search Report dated Jul. 4, 2008, from corresponding PCT application.

(Continued)

*Primary Examiner* — Sean Kayes
(74) *Attorney, Agent, or Firm* — Young & Thompson

(57) ABSTRACT

A ringing mechanism includes: a power source (12), a speed regulator (14), a ringing device, and a gear (10) connecting the power source (12) to the regulator (14) on the one hand and to the device on the other hand. The mechanism further includes a speed adjustor (16) and control element interacting with the speed adjustor (16) in order to change the driving speed of the ringing device.

9 Claims, 10 Drawing Sheets

U.S. PATENT DOCUMENTS

| | | | | |
|---|---|---|---|---|
| 7,813,227 | B2 * | 10/2010 | Subilia et al. | 368/272 |
| 2009/0033162 | A1 * | 2/2009 | Dugas | 310/74 |

FOREIGN PATENT DOCUMENTS

| | | |
|---|---|---|
| EP | 1 408 381 | 4/2004 |
| FR | 338 591 | 8/1908 |
| FR | 412 747 | 7/1910 |
| FR | 427 919 | 8/1911 |
| FR | 19 057 | 9/1914 |
| GB | 12880 | 11/1908 |

OTHER PUBLICATIONS

European Search Report dated Sep. 24, 2007, from corresponding European application.

* cited by examiner

HOUR INDICATING RINGING MECHANISM

TECHNICAL FIELD

The present invention relates to hour indicating ringing mechanisms, whether in passing or of the repetition type.

BACKGROUND OF THE INVENTION

Such ringing mechanisms are well known by those skilled in the art. They make it possible to indicate the time with sounds, through a succession of notes struck on gongs. Such watches comprise a power source and a ringing device and are, for example, described in the work entitled "Les montres compliquées" by François Lecoultre, Editions horlogéres, Bienne, 1951.

Such mechanisms require significant settings, in order to ensure a high sound quality while requiring only a very small amount of power. One of the most delicate settings concerns adjusting the frequencies of the blows struck. This setting is obtained by a speed regulator connected to the power source by a gear. In the known systems, the regulator may be of the type with a flywheel or comprise a recoil pallet cooperating with a ratchet wheel whereof the working conditions define the frequency of the striking. The amplitude of the pallet is defined by an eccentric mounted with hard friction on the frame. The greater the amplitude, the lower the frequency of the blows. Adjusting the frequency is therefore done at the end of the kinematic chain, on the organ ensuring the stability of the frequency of the sound signal.

This setting is done by a watchmaker, during manufacturing, and involves relatively delicate operations. If the wearer wants a slower or faster signal, or if other factors have led to a modification of the signal frequency, it is then necessary to call on a specialist.

BRIEF DESCRIPTION OF THE INVENTION

The aim of the present invention is to offset these drawbacks. This aim is achieved thanks to the fact that the mechanism comprises, moreover, a speed adjuster, as defined in the claims. Thanks to this, the frequency of the blows can be adjusted easily and more precisely.

The present invention also concerns a ringing watch movement equipped with a mechanism according to the invention, as well as a watch provided with a movement of this type. This watch also comprises a case provided with a control member accessible from the outside and cooperating with the control means. In this way, the user himself can change the frequency of the ringing, without having to open the case.

BRIEF DESCRIPTION OF THE DRAWINGS

The invention will be better understood upon reading the description which follows, given as an example and done in reference to the appended drawing in which:

FIGS. 4 and 5 illustrate, in cross-section, a speed changing organ according to a second embodiment, in two extreme positions, while

DETAILED DESCRIPTION OF THE INVENTION

Figure 1:
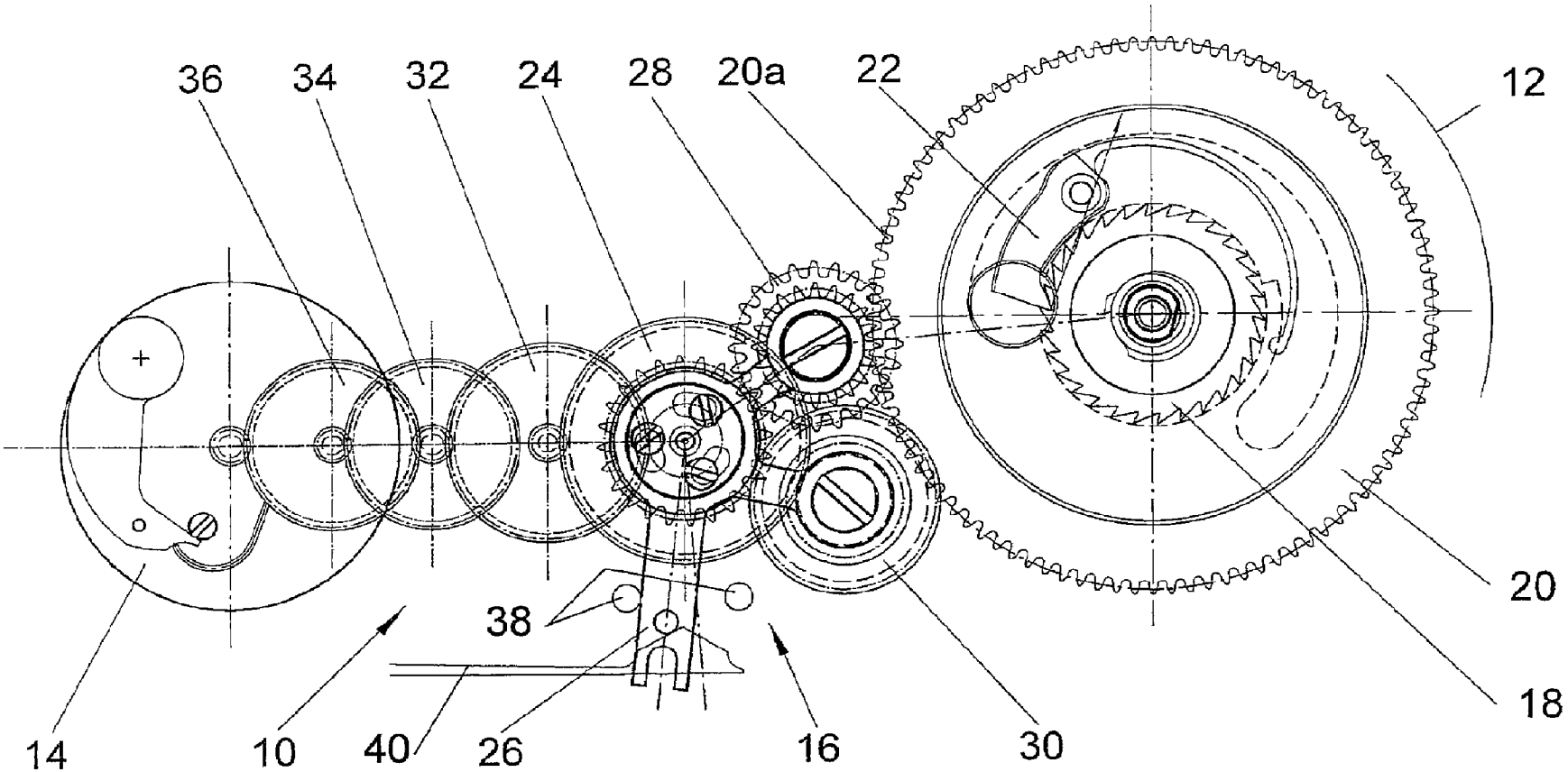
FIGS. 1 and 2 illustrate, in flat view and cross-section, respectively, the schematic diagram of a first embodiment of a mechanism according to the invention, in a first working position.
Figure 2:
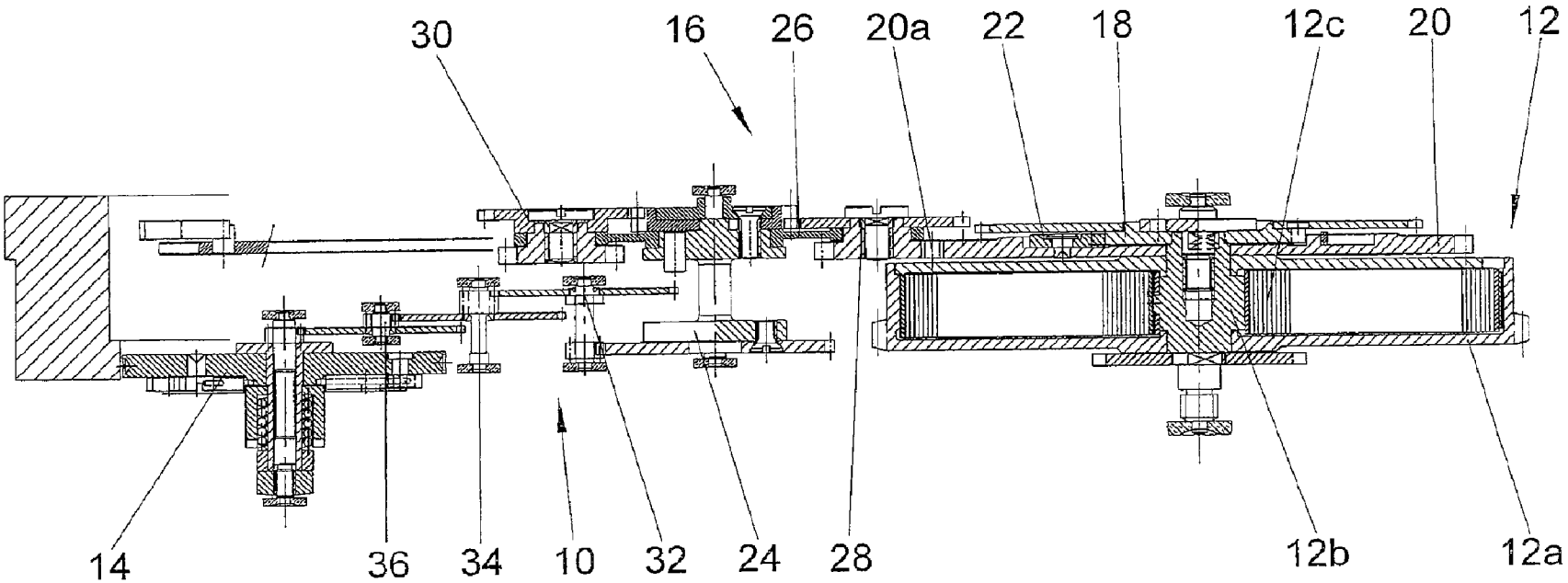
Figure 3:
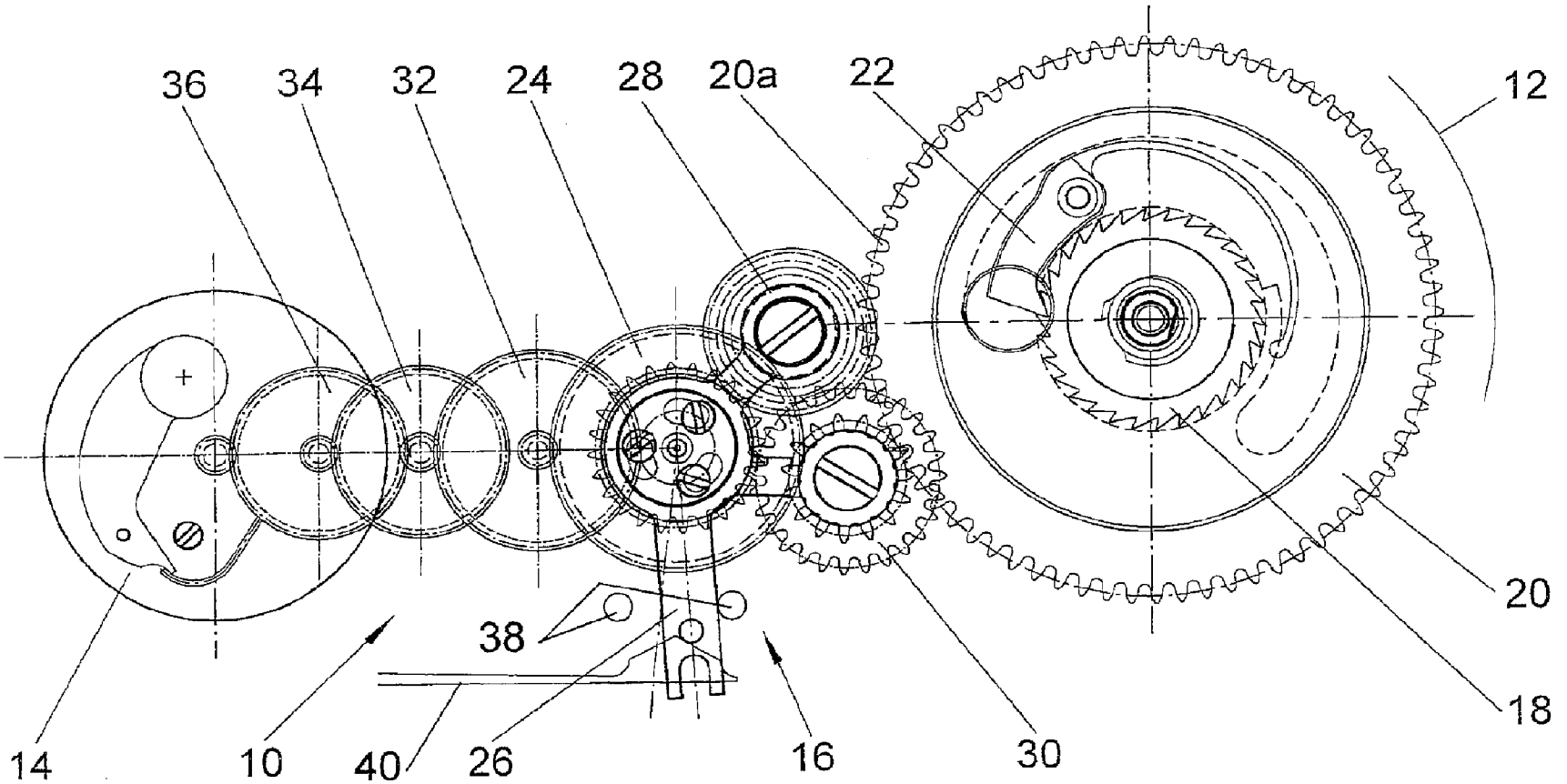
FIG. 3 is a flat view of the mechanism of FIGS. 1 and 2, in a second working position.

The first embodiment of the mechanism according to the invention is illustrated in FIGS. 1 to 3; it essentially comprises, arranged on a frame (not shown) and which supports bearings designed to allow pivoting of the mobile parts:

- a gear 10, mounted pivoting on the frame,
- a power source made up of a barrel 12,
- a speed regulator 14 primarily made up of a flywheel connected to the barrel 12 by the gear 10 for which it ensures regulation of the rotational movement, and
- a speed adjuster 16 integrated to the gear 10.

The barrel 12 comprises (FIG. 2) a drum 12*a*, an arbor 12*b* mounted pivoting on the frame and on which the drum 12*a* can turn, and a spring 12*c* housed inside the drum 12*a* and connected thereto by its outer end and to the arbor by its inner end.

The arbor 12*b* supports, integral in rotation, a wheel 18 provided with wolf teeth. A wheel 20 is mounted idle on the arbor 12*b*. It supports a spring pawl 22 engaged in the toothing of the wheel 18. It is provided with an outer toothing 20*a*, forming the first wheel of the gear 10 and designed to cooperate with the device 16, as will be explained later.

The adjuster 16 comprises a wheel assembly 24 mounted pivoting on the frame and a lever 26 integral with the arbor of the wheel assembly 24 and which can go from one to the other of the two positions illustrated in FIGS. 1 and 3. The lever 26 also supports two wheel assemblies 28 and 30 each comprising a wheel and a pinion. These wheel assemblies mesh continuously via their wheel with the wheel assembly 24, while the pinions of the wheel assemblies 28 and 30 mesh respectively with the wheel 20 depending on whether the lever 26 occupies the positions illustrated in FIGS. 1 and 3.

The number of teeth comprised by the wheels of the wheel assemblies 28 and 30 are different. In the example illustrated in the drawing, the wheel of the wheel assembly 28 comprises twenty-four teeth, that of the wheel assembly 30, twenty-seven. As all of the other components of the kinematic chain between the barrel 12 and the speed adjuster 14 do not change, the gear ratio between the configurations illustrated in FIGS. 1 and 3, respectively, is 9/8.

The gear 10 also comprises three wheel assemblies 32, 34, 36. The pinion of the wheel assembly 32 is driven by the wheel of the wheel assembly 24, while the wheel of the wheel assembly 36 drives the flywheel.

The gear 10 also comprises at least one wheel assembly (not shown) meshing with the wheel 20 and connected to a control device actuating a hammer designed to strike on a gong, at given moments. This part of the mechanism is well known by those skilled in the art. It is in particular described in the work previously mentioned.

The frame supports two banking elements 38 cooperating with a positioning member 40 to allow the lever 26 to be able to occupy two stable positions, illustrated in FIGS. 1 and 3, respectively. Without there being a need to describe them further, one skilled in the art will be able to choose the technically suitable solution to produce the banking elements and the positioning organ.

Thus, for an average winding of the barrel spring, the ringing has a duration of approximately 18 seconds when the gear 28 is engaged with the wheel 20, and 20 seconds, when the gear 30 meshes with the wheel 20, or a gap of approximately two seconds between the two positions.

Figure 4:
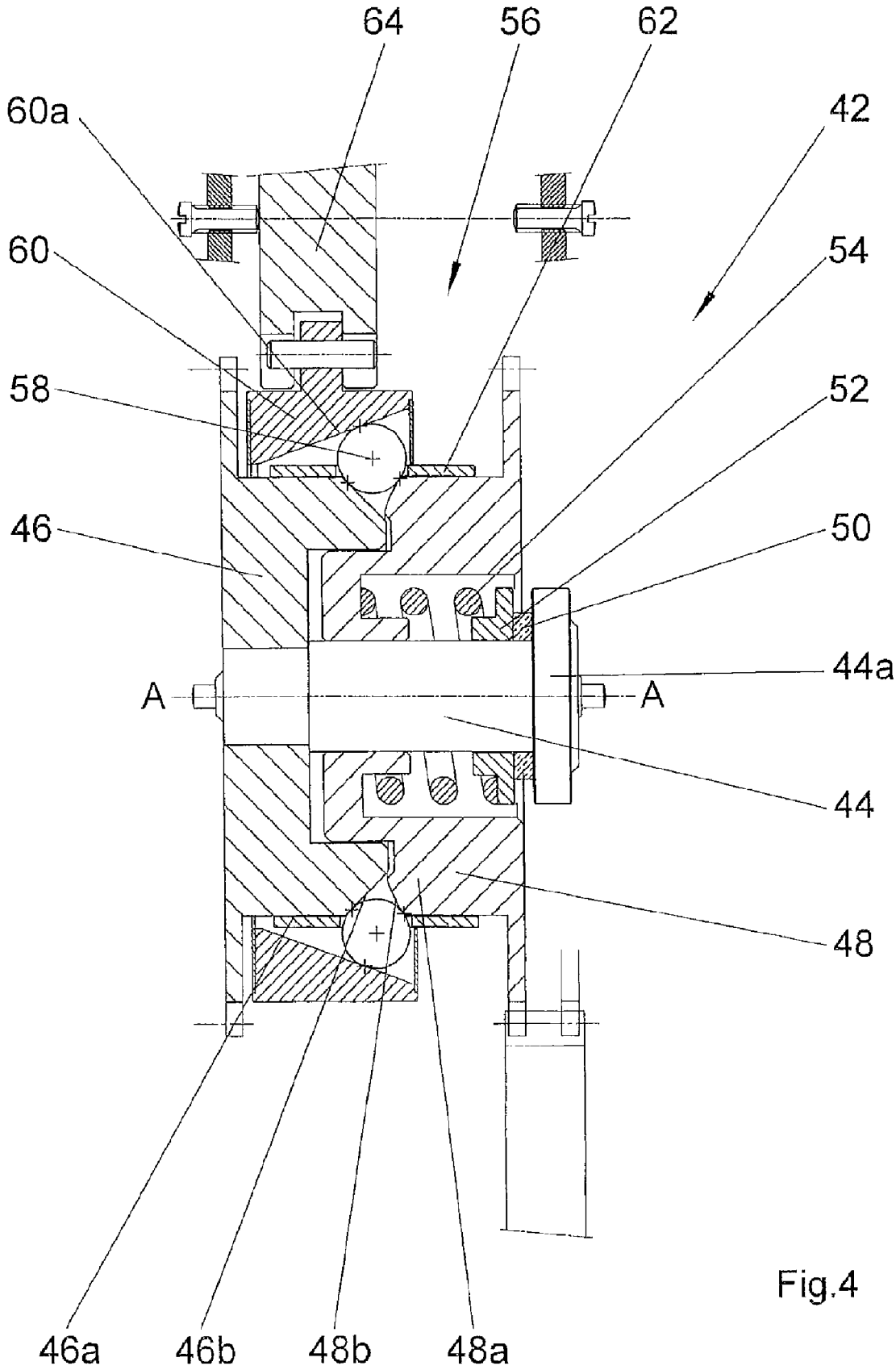
Figure 5:
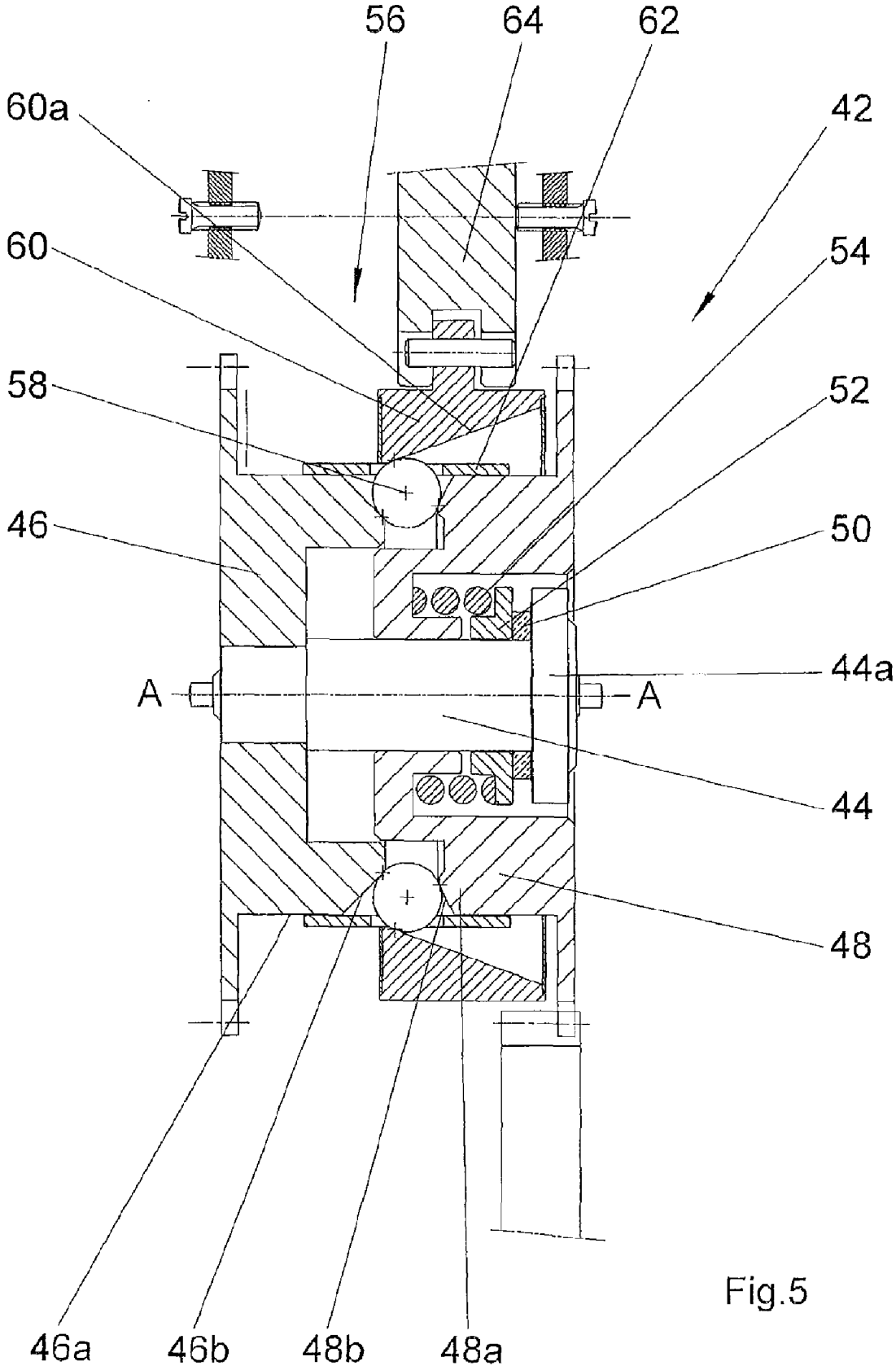
Figure 6:
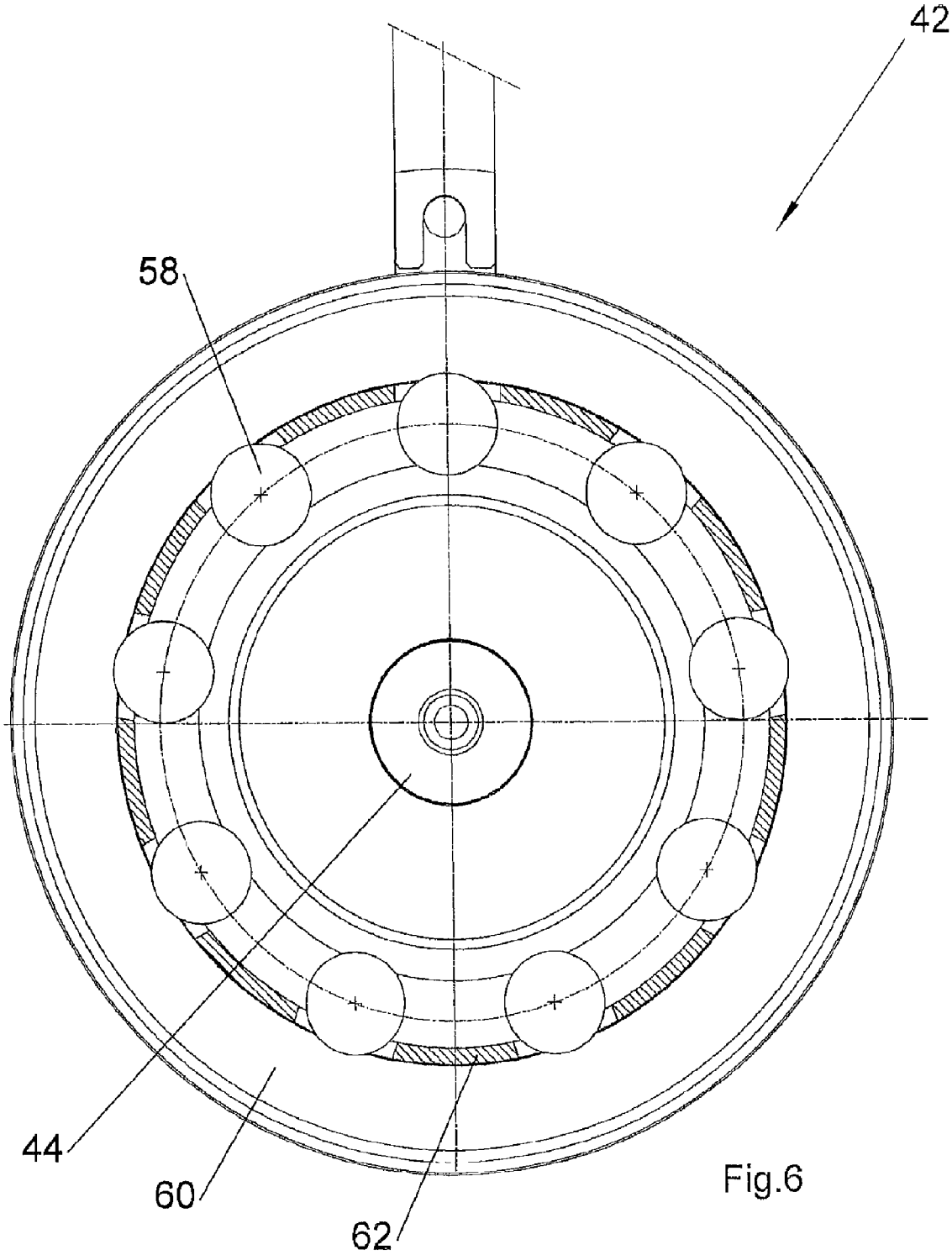
FIG. 6 shows this organ from the top, in the position corresponding to FIG. 5, FIG. 7 diagrammatically shows different possible configurations to ensure the change of frequency of the ringing.

FIGS. 4 to 6 show another type of adjuster 42, with ball bearing, designed to replace the adjuster 16 previously described. The mechanism of FIGS. 1 to 3 equipped with an organ of this type corresponds to a second embodiment. This adjuster is, as shown in FIG. 5, adjusted such that the flywheel constituting the speed adjuster 14, has a maximal speed, and in FIG. 4 a minimal speed.

The adjuster 42 comprises:

an arbor 44 mounted pivoting on the frame, defining an axis AA and provided with a collar 44*a* at one of its ends, an output wheel 46 engaged with the gear 32, fixed rigidly on the arbor 44 and provided with a first cylindrical portion 46*a* whereof the free end is truncated to form a first conical surface 46*b*, an input wheel 48 engaged with the wheel 20, mounted pivoting and sliding on the arbor 44, provided with a second cylindrical portion 48*a* oriented toward the wheel 46 and with the same outer dimension as the cylindrical portion 46*a*, and forming a second conical surface 48*b*, an intermediate stone 50, bearing against the collar 44*a*, a socket 52 mounted pivoting on the arbor 4, bearing against the stone 50, a spring 54 arranged between the socket 52 and the turning-arbor 48*a*, and tending to push the wheel 48 toward the wheel 46, a ball bearing 56 comprising balls 58, a frame 60 provided with a third conical surface 60*a*, and a ring 62 in which are engaged the turning-arbor 48*a* and the cylindrical portion 46*a*, the balls 58 being arranged so as to be in contact with the conical surfaces 46*b*, 48*b* and 60*a*, and positioned by the ring 62, a control carriage 64 connected to the arbor 60 and mounted on the frame so as to be able to move along a direction parallel to the axis AA, a control organ arranged so as to allow the movement of the carriage 64 between first and second extreme positions, defined by bankings, respectively, and corresponding to the maximum and minimum run times of the ringing.

As one can see more particularly in FIGS. 4 and 5, the ring 62 is mounted pivoting and sliding on the cylindrical portions 46*a* and 48*a*. It angularly positions the balls 58 in relation to each other, while allowing them to roll and move radially.

The conical surface 46*b* has an apex angle different from that of the conical surface 48*b*. In the example, the apex angle defined by the surface 46*b* is smaller than that defined by the surface 48*b*.

The conical surfaces 46*b*, 48*b* and 60*a* respectively form first, second and third rolling surfaces for the balls 58. Unlike a conventional ball bearing, one will note that the conditions for friction between the balls and the rolling surfaces must allow the balls to roll and not slide on the surfaces 46*b*, 48*b* and 60*a*. In this way, the input wheel drives the output wheel. Because the angles of the conical surfaces are different, the points of contact of the balls with the conical surfaces 46*b* and 48*b* are located at different distances from the axis AA; the rolling paths of these balls therefore are not the same length. This causes a speed differential between the input wheel and the output wheel, variable according to the position of the respective contact points of the balls with the conical surfaces 46*b* and 48*b* and also according to the apex angles defined by these surfaces.

By acting on the control organ so that the wheel reaches its maximal speed and therefore, the duration of the ringing is minimal, the frame 60 is moved along a direction parallel to the axis of the arbor 44, in the direction of the wheel 48. The wheel 48 is then pushed back, the spring 54 being compressed. This situation is illustrated in FIG. 5. For an average winding of the barrel spring, the ringing then lasts approximately 15 seconds.

By acting on the control organ so that the wheel reaches its minimal speed and therefore, the duration of the ringing is maximal, the spring 54 causes the cylindrical portion 48*a* to penetrate the cylindrical portion 46*a*, pushing the balls 58 radially outward, which increases the ratio between the speed of the input wheel 58 and the output wheel 46. This situation is illustrated in FIG. 4. For an average winding of the barrel spring, the ringing then lasts approximately 17 seconds, or 2 seconds longer than in the position of FIG. 5.

Advantageously, the control organ can be stabilized at each position between the first and second extreme positions. In this way, the duration of the ringing can be adjusted continuously, between the maximum and minimum durations.

The control organ can, for example, be a worm screw accessible from the inside of the watch case, so as to be able, using a screwdriver, to adjust the duration and frequency of the hour ringing.

One will note that the control organ could also act on the position of one of the input or output wheels, an elastic organ maintaining the conical surface of the frame 60 in contact with the balls.

Figure 7:
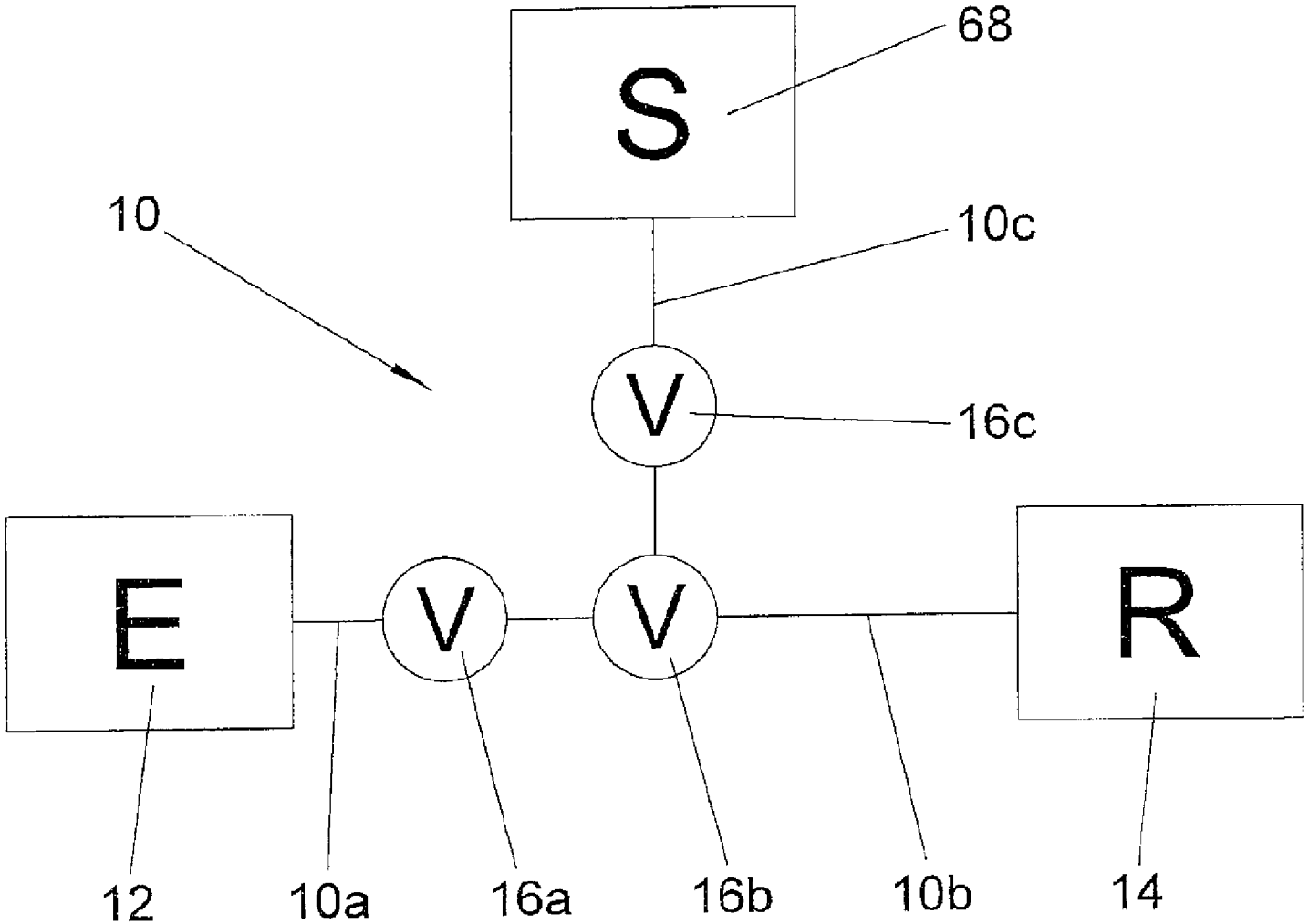

FIG. 7 diagrammatically illustrates the manner in which the speed adjuster can be integrated into the gear 10, in a watch equipped with a speed regulator, of the flywheel type for example. In this diagram, one can see the power source 12, the speed regulator 14 and the ringing device 68 diagrammatically illustrated by rectangles. They are connected to each other by the gear 10, which comprises three branches 10*a*, 10*b* and 10*c*, connected to the power source 12, the speed regulator 14 and the ringing mechanism 68, respectively. In this mechanism, the speed adjuster 16 can be placed in one or the other of the three locations, identified 16*a*, 16*b* and 16*c*, or on the branch 10*a*, the branch 10*c* and at the intersection of the three branches.

If the mechanism according to the invention was provided with a substantially isochronous speed regulator, it would then be possible to place the adjuster at positions 16*b* or 16*c*, or on the branch 10*b*.

Figure 8:
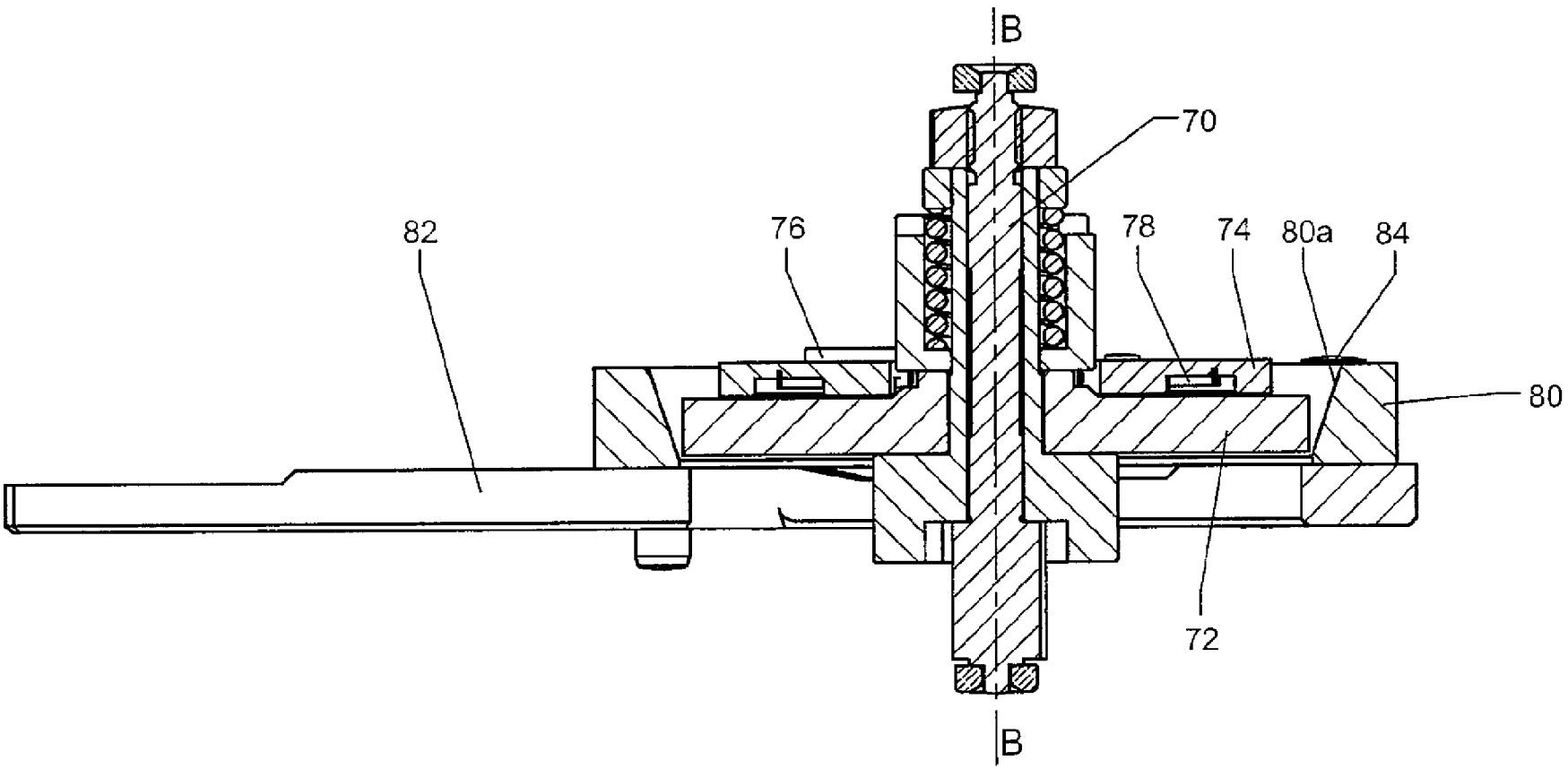
FIGS. 8 and 9 show, in cross-section and top view, a third embodiment.
Figure 9:
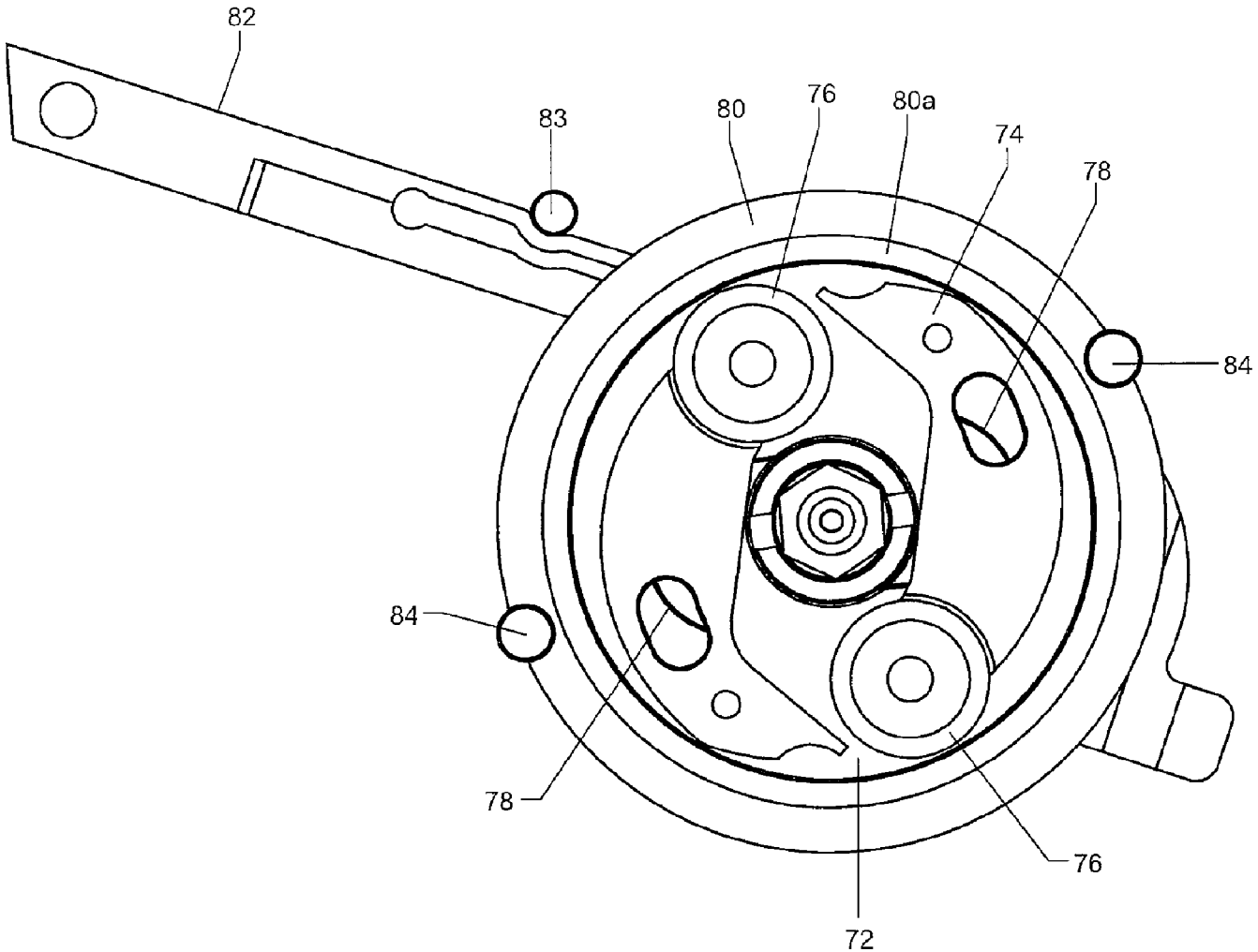
Figure 10:
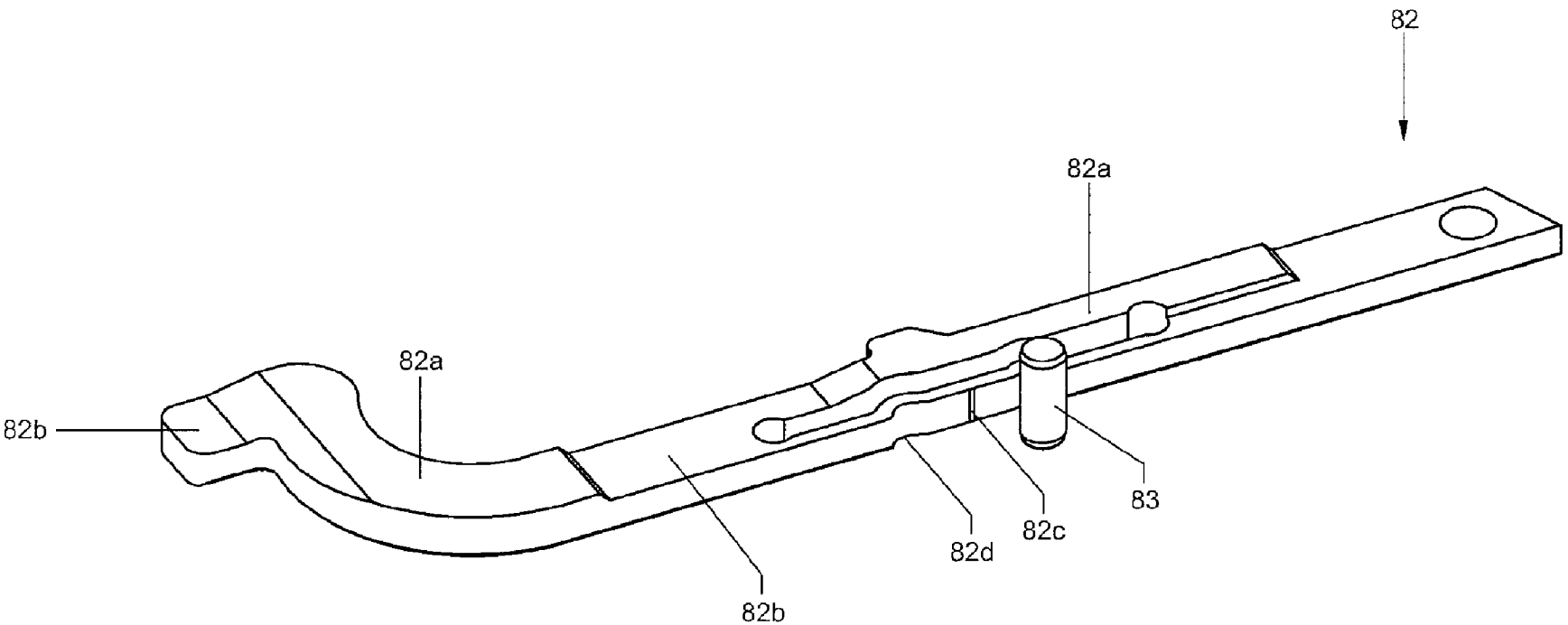
FIG. 10 illustrates a detail of this third embodiment.

FIGS. 8 to 10 show a third embodiment of a speed adjuster according to the invention. The essential device of this variation is the flywheel ending the striking gear and constituting the speed regulator 14. The rest of the ringing gear connecting the barrel to the flywheel is conventional.

The flywheel comprises an arbor 70, pivoting on elements of the frame and kinematically connected to the ringing barrel 12. This arbor serves as a pivot axis BB for a plate 72 on which arms 74 ending by rubbing organs 76, for example stones, are pivoted. Light springs 78 slightly stress the arms by pushing them toward the center of the plate 72. An annulus 80 mounted on the frame is arranged concentrically to the arbor 70. It surrounds the arms 74 and is located in the plane of the rubbing organs 76.

Like a traditional flywheel, when the ringing mechanism is in operation, the arbor 70 is driven in rotation and with it, the plate 72. Under the effect of the centrifugal force, the arms 74 oscillate around their pivot point and the rubbing organs 76 come into contact with the ring and rub against it. By reaction and under the effect of the springs, the arms 74 pivot and the frictional organs 76 move toward the arbor 70, before coming back, under the effect of the centrifugal force, into contact again with the ring 80 and so on. The arms thus describe an oscillating movement in a plane perpendicular to the axis BB, which causes the inertia of the wheel to vary. Moreover, the rubbing organs intermittently come into contact with the ring. This makes it possible to adjust the unwinding speed of the ringing barrel and therefore the frequency with which the blows to the ringing mechanism are struck.

The ring 80 defines an inner wall 80*a* which, according to the invention, has a variable diameter. Preferably, the variation of the diameter is continuous such that this inner wall 80*a* is tapered. The relative position of the rubbing organs 76 and the ring 80 along the axis BB is adjustable. Thus, the rubbing organs can come into contact with the ring at different levels in reference to the axis BB. The contact point between the organs and the ring can therefore be located at different distances in relation to the center of the ring 80.

In order to vary the relative position of the rubbing organs 76 and the ring 80 along the axis BB, the embodiment illustrated in the drawing proposes the ability to move the ring along the axis BB. To do this, the ring is placed on a support formed by a positioning lever 82, particularly illustrated in FIG. 10. Pins 84 are positioned in the frame so as to vertically guide the ring 80 and ensure its position in relation to the axis BB. At least one spring organ (not shown) exerts a force on the ring tending to push it against the lever.

The positioning lever is in contact with the ring in two areas, defining a chord in relation to the circle formed by the ring 80. The lever comprises a first pair of surfaces 82*a*, located in a first plane and separated from each other by a distance equal to the cord defined above. Thus, when the ring is pushed on the first pair of surfaces 82*a*, the rubbing organs 76 can come into contact with the inner wall 80*a* of the ring at a first level, in points located at a first distance in relation to the center of the ring.

The lever comprises a second pair of surfaces 82*b*, located in a second plane different from the first in reference to the ring and also separated from each other by a distance equal to the chord. Thus, when the ring 80 is pressed on the second pair of surfaces 82*b*, the frictional organs 76 can come into contact with the inner wall of the ring at a second level, in points located at a second distance in relation to the center of the ring.

The lever 82 is mounted mobile in relation to the ring and can move between first and second positions, in which the latter part is pushed on the first or the second pair of surfaces, respectively. The lever can be actuated from the outside of the watch by its wearer. Advantageously, the lever 82 is arranged such that its first and second positions are marked and stabilized by a notch. To do this and according to the illustrated example, the lever 82 comprises an elastic portion 82*c* provided with two housings 82*d*, capable of cooperating with a fixed element, such as a pin 83, fixed on the frame. Preferably, the elastic portion 82*c* can be formed such that the pin can only be positioned in the zone defined by the two housings. To this end, the edge of each of the housings 82*d*, located opposite the other housing, is high enough that, despite the elasticity of the zone, the fixed pin 83 cannot cross it. The elastic zone 82*c* is formed such that, if the pin is bearing between the two housings, it returns into position in one or the other of the housings. One thus obtains a jumper spring function, i.e. the lever 82 can only be in its first or second positions.

One therefore has, side by side on the lever, a surface which is part of the first pair 82*a* and a surface which is part of the second pair 82*b*, a threshold being formed between these two surfaces. In order to promote the passage of the support of the ring between the first pair and the second, the threshold is not at a right angle, but rather is tilted.

Guide organs can be provided in order to optimize the translation of the lever 82. The surfaces of the lever are thus perfectly positioned in relation to the ring 80.

Thus, depending on the position of the lever 82 chosen by the user, the rubbing organs 76, mounted on the arms 74, have a more or less large distance to travel before coming into contact with the inner wall 80*a* of the ring 80. The movements of the arms 74, at a given angular speed, are determined by their masses, the elastic characteristics of the springs 78, the mass of the rubbing organs 76 and their positioning in relation to the pivot center. The obvious result of this is that the angular speed necessary for the rubbing organs to come into contact with the ring varies according to the parameters cited above. Adjusting the pre-winding of the springs 78 makes it possible, for example, to adjust the average duration of the ringing, and changing the distance to be traveled by the rubbing organs 76 makes it possible to go from slow speed to high speed.

One will note that additional positions can be provided, in order to offer more adjustments of the frequency. The ring could also be moved by first and second surfaces arranged in different planes in reference to the ring and only acting on one zone of the ring. The surfaces therefore would not be arranged in pairs. The pins 84 provided for vertical guiding of the ring ensure that the latter part translates without putting itself at an angle. The lever can also have slanted planes such that the position of the ring can be adjusted continuously. The lever surfaces could also not comprise Moreover, other solutions can be considered by one skilled in the art to modify the relative level of the ring and of the rubbing organs. For example, the ring could be raised via a screw, also offering the possibility of continuously varying the frequency of the ringing. The plate could also be moved, even if such a solution is less simple a priori, in order to preserve the kinematic connection with the ringing gear.

Thus are proposed embodiments making it possible to vary the speed of a watch ringing mechanism. Of course, the description above was provided solely as a non-limiting example of the invention and one skilled in the art will be able to provide for various variations without going beyond the scope of the invention, particularly concerning the speed or gear ratios. In the second embodiment, the bearing surfaces for the balls can also not be perfectly conical, but have a certain concavity or convexity.

The invention claimed is:

1. A ringing mechanism comprising:

a power source, a speed regulator including a flywheel comprising a plate pivoting around an axis BB and kinematically connected to the power source, at least one arm ending by a rubbing organ pivoted on said plate, and a ring arranged concentrically to the plate, surrounding the arm and being located in the plane of the rubbing organ, a ringing device, and a gear connecting the power source on one hand to said regulator, on the other hand to said ringing device, a speed adjuster, and control means cooperating with the speed adjuster so as to allow the change of the driving speed of the ringing device, wherein the speed adjuster is integrated into the flywheel.

2. The mechanism of claim 1, wherein said plate is mobile along the axis BB.

3. The mechanism of claim 1 in which the ring defines an inner wall, wherein said inner wall has a variable diameter and in that the relative position of the rubbing organ and of the ring along the axis BB is variable, such that the distance to be traveled by the rubbing organ before coming into contact with the inner wall of the ring is variable.

4. The mechanism of claim 3, wherein said ring is mounted mobile along the axis BB.

5. The mechanism of claim 4, comprising a support provided with at least first and second surfaces arranged in different planes in reference to the ring, said ring being able to be pressed against the first or second surfaces.

6. The mechanism of claim 5, wherein the support comprises first and second pairs of surfaces arranged in different planes in reference to the ring.

7. The mechanism of claim 6, wherein the support is a positioning lever capable of evolving between first and second positions, in which said ring is pressed against the first or second pairs of surfaces, respectively.

8. The mechanism of claim 5, wherein the support is a positioning lever capable of evolving between first and second positions, in which said ring is pressed against the first or second pairs of surfaces, respectively.

9. A clockwork movement comprising a ringing mechanism according to claim 1.

* * * * *